US005776571A

United States Patent [19]

Michlin et al.

[11] Patent Number: 5,776,571

[45] Date of Patent: Jul. 7, 1998

[54] COMBINED FORM AND LABEL CONSTRUCTION

[75] Inventors: Irving R. Michlin, Roanoke; Guy Kiraly, Troutville, both of Va.; Frank H. Neubauer, Mt. Kisco, N.Y.

[73] Assignee: Transkrit Corporation, Roanoke, Va.

[21] Appl. No.: 531,292

[22] Filed: Sep. 20, 1995

[51] Int. Cl.[6] ..... G09F 3/00

[52] U.S. Cl. ..... 428/40.1; 40/638; 281/2; 281/5; 283/81; 428/41.7; 428/41.8; 428/42.1; 428/42.2; 428/43; 428/68; 428/121; 428/131

[58] Field of Search ..... 428/40.1, 41.7, 428/41.8, 42.1, 42.2, 43, 68, 76, 121, 131, 220; 283/81; 40/638; 281/2, 5

[56] References Cited

U.S. PATENT DOCUMENTS

| | | | |
|---|---|---|---|
| 3,155,234 | 11/1964 | Knoll | 206/47 |
| 4,868,027 | 9/1989 | Hunkeler | 428/42.3 |
| 4,889,234 | 12/1989 | Sorenson | 428/41.9 |
| 5,376,418 | 12/1994 | Rogers | 428/41.7 |
| 5,403,636 | 4/1995 | Crum | 283/81 |

*Primary Examiner*—Nasser Ahmad

*Attorney, Agent, or Firm*—McAulay Fisher Nissen Goldberg & Kiel, LLP

[57] ABSTRACT

The combined form and label construction has a label portion with a glue frame on the back side for securement to a shipping container. A form portion is secured to the label portion for processing through a laser printer or the like to receive information. In one embodiment, the form portion is removable from the label portion to permit the label portion to be secured along three lines of glue to a shipping carton to form a pocket therewith. The form portion is then folded and inserted into the pocket and the remainder of the label portion is then secured to the shipping carton to seal the pocket. In the embodiments, the form portion is folded under the label portion within the glue frame prior to securement of the label portion to a container. A tear strip in the label portion allows for opening of the pocket to permit removal of the form portion.

26 Claims, 4 Drawing Sheets

FIG. 1
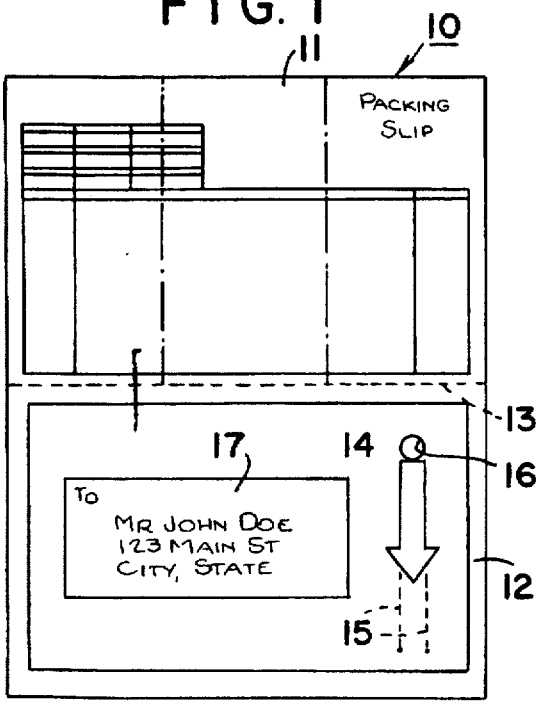
FIG. 2
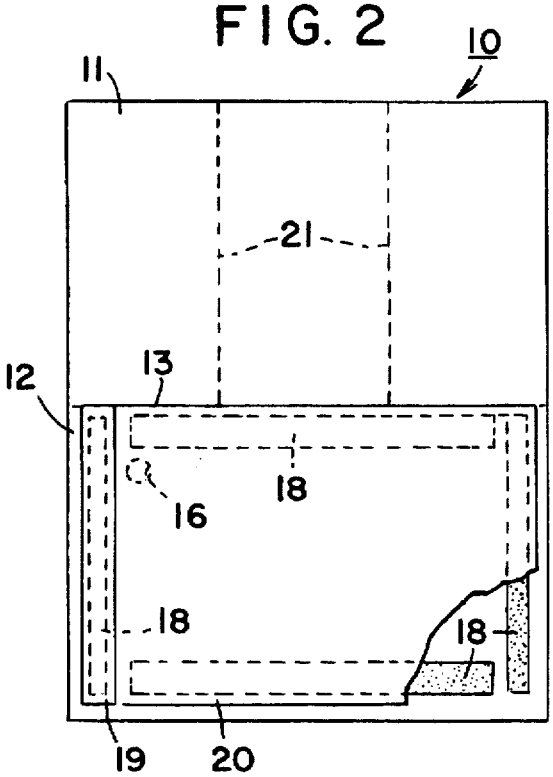
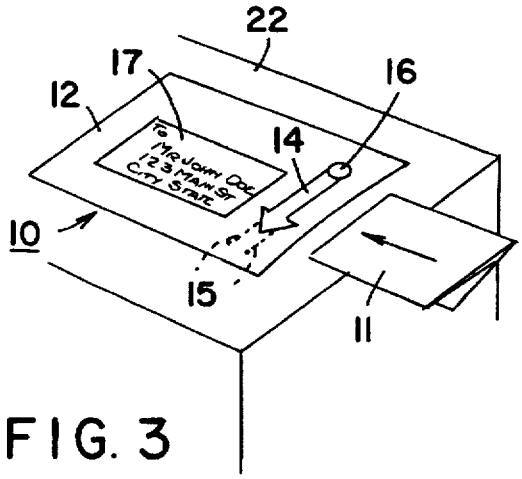
FIG. 3
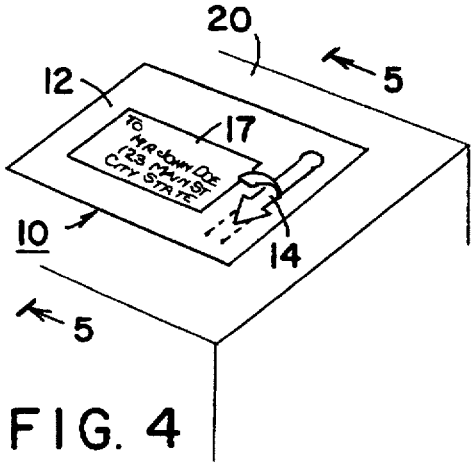
FIG. 4
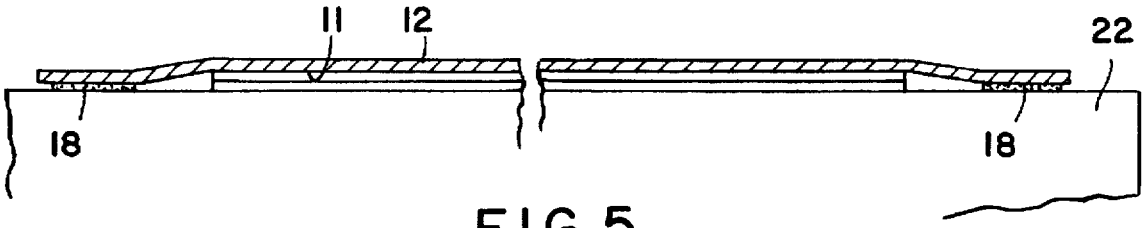
FIG. 5

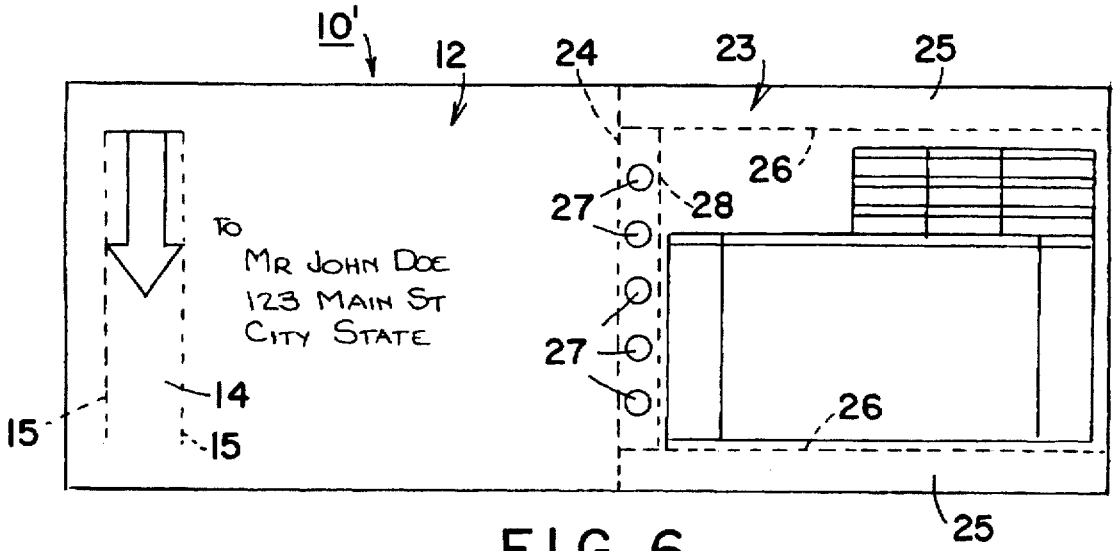
FIG. 6
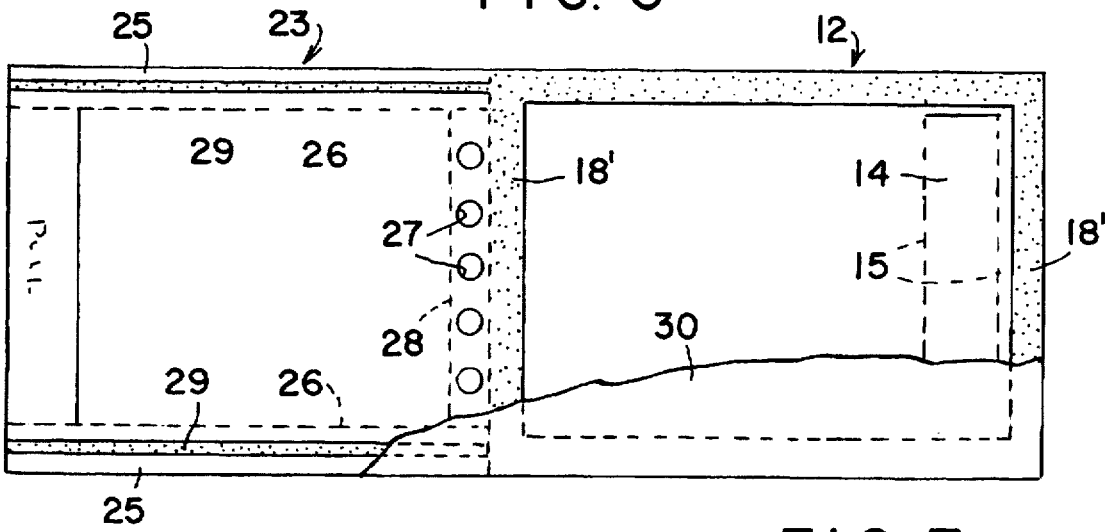
FIG. 7
FIG. 8
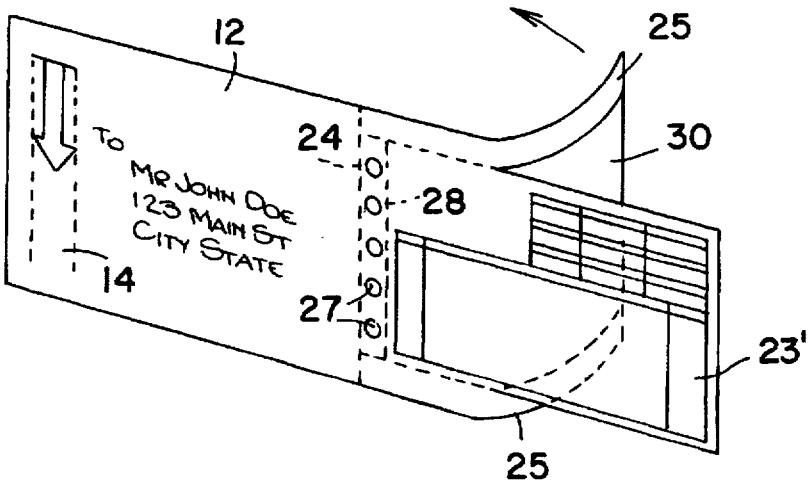

FIG. 14
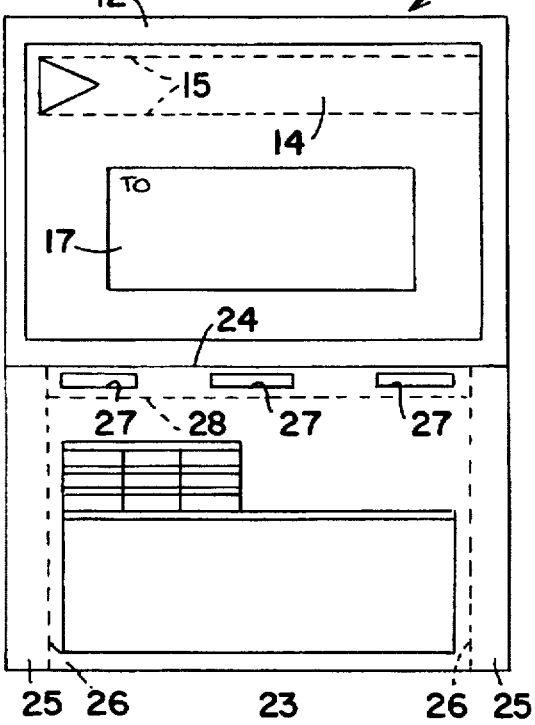
FIG. 15
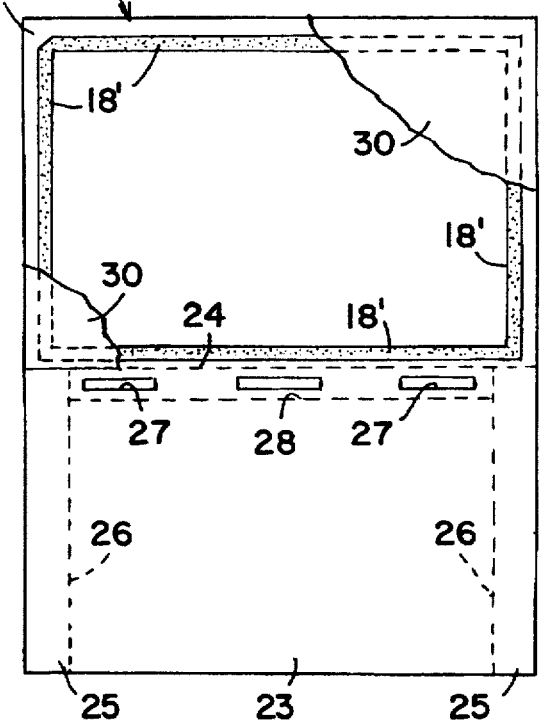
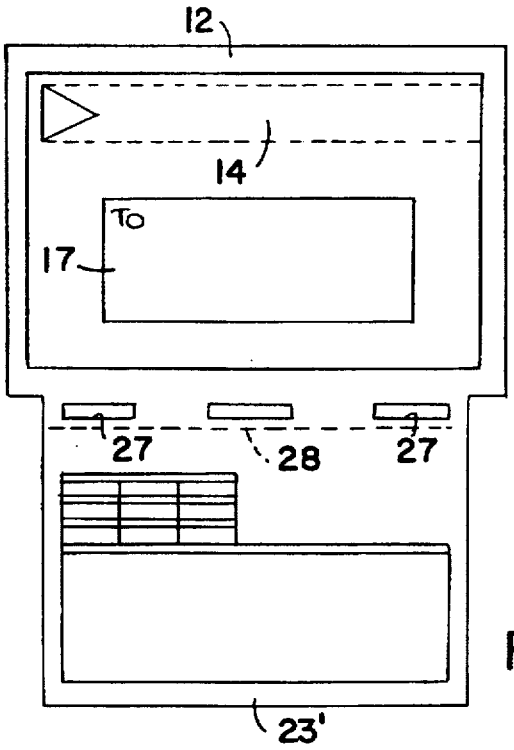
FIG. 16
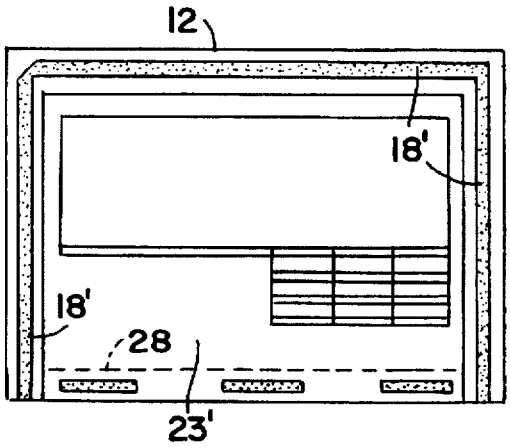
FIG. 17
FIG. 18
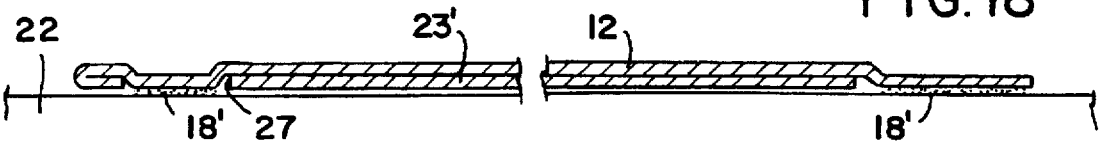

COMBINED FORM AND LABEL CONSTRUCTION

BACKGROUND OF THE INVENTION

This invention relates to a combined form and label construction. Heretofore, various types of devices have been known for securement to a shipping carton for addressing purposes. One simple form of device is a gummed packing label which is adhesively secured to the shipping carton. Such a packing label typically includes printed areas and/or lines to receive the address of the intended recipient as well as the return address of the sender.

In more sophisticated circumstances, devices have been used which employ an envelope which can be secured to a shipping container. For example, by means of an adhesive or the like. In many cases, the envelopes have been constructed so that by removing a tear strip or the like from the face of the envelope the recipient is able to gain access to the interior of the envelope and the contents therein, such as invoices, advertisements and/or other media related to the goods in the container.

In still other instances, it has been known to secure a transparent plastic type of envelope to a shipping carton and to slide a packing slip into the plastic envelope. Typically, the plastic envelope is constructed to protect the packing slip, which is usually made of paper, from the outside environment, particularly rain, sleet and/or snow or the like, during transport.

While these various devices have advantages, most have disadvantages. For example, a label which is secured to a shipping container simply provides information as to the recipient and the sender. The more sophisticated types of devices are relatively expensive to manufacture and to secure to a shipping container.

SUMMARY OF THE INVENTION

Accordingly, it is an object of the invention to provide a combined form and label construction which is simple to use and inexpensive to manufacture.

It is another object of the invention to reduce the cost of securing shipping labels and forms such as to a shipping container.

It is another object of the invention to provide a combined packing slip, or the like and label construction which can be imprinted with a laser printer, impact printer or the like with various types of information.

It is another object of the invention to be able to process a packing slip, or the like, with a label in the same type of printing machine prior to affixing to a shipping container or the like.

It is another object of the invention to be able to secure packing slips, invoice, messages and the like under a label affixed to a shipping carton in a readily removable manner.

Briefly, the invention provides a combined form and label construction which is comprised of a form portion for receiving information thereon and a label portion removably connected to the form portion. In addition, the label portion has a removable tear strip near one edge and a plurality of glue strips or dots or the like on a back side in order to define a glue frame.

In one embodiment, a backing strip is disposed over a part of the back side of the label portion while being releasably secured to a glue strip adjacent and parallel to one edge of the label portion. Further, a backing sheet is disposed over the remaining part of the back side of the label portion while being releasably secured to the remainder of the glue strips thereon.

In use, the combined form and label construction is processed through machinery, such as a laser printer, in order to receive information on both the form and the label. For example, where the combined form and label construction is to be used with a shipping container, the form portion which may function as a packing slip or invoice is provided with a description of the goods within the shipping carton as well as other information pertinent to the goods. The label portion is likewise provided with information regarding the addressee, that is the intended recipient of the shipping carton, as well as the sender. The name of the sender may be provided at the time that the name and address of the intended recipient is printed on the label or may be pre-printed.

Next, the packing slip is separated from the label portion, for example along a line of weakening, such as a perforation extending between the two portions. The backing sheet which covers a major part of the back side of the label portion is then peeled back by the user to expose the lines of glue on the label portion. In this respect, the glue is of such a nature that the backing may be readily removed while the glue retains adherent characteristics. The label portion is then applied to a shipping carton via the exposed lines of glue. In this way, the exposed back of the label portion and the surface of the shipping carton form a pocket which is defined by the lines of glue of the label portion.

Next, the packing slip which has been separated from the label portion is folded at least once or twice and slid into the pocket defined between the label portion and the shipping carton. This is possible since the backing strip over the remaining line of glue on the label portion has not yet been removed. Once the packing slip has been inserted into the pocket, the backing strip is peeled off the remaining glue strip of the label portion. This end of the label portion is then pressed against the shipping carton so that the now exposed line of glue secures the remainder of the label portion to the shipping carton. In this way, the packing slip is sealed in the pocket formed between the label portion and the shipping carton.

When a recipient receives the shipping carton, the recipient simply removes the removable tear strip in the face of the label portion to open the pocket thereby permitting removal of the packing slip.

In order to enhance the removability of the tear strip, the label portion may be provided with a hole or a die cut at one end of the tear strip to allow access to the end of the tear strip for removal from the label portion.

Typically, the glue strips on the back side of the label portion are continuous lines of glue. Alternatively, a series of glue dots or an interrupted glue line may be used.

Typically, the removable backing strip is of a minor width to lay over only one glue strip on the back of a label portion. Alternatively, the backing strip may be quite larger so as to lay over some of the remaining glue strips. For example, two backing sheets may be used with each covering approximately one-half of the back side of a label portion. In this case, after one backing sheet is removed, the label portion may be applied to a container, such as a shipping container, with a packing slip being inserted into the "half" pocket which is then formed. After the second backing sheet is removed, the remainder of the packing slip is closed over when the second half of the label portion is secured to the container. Thus, the relative sizes of the backing strip and backing sheet are not critical to the functioning of the label portion when applied to a container.

The combined structure may be sized to a conventional size of a cut sheet, for example constituting an 8½"×11"

form and label construction, to facilitate processing in a laser printer. Also, the combined structure may be fabricated in a continuous format with a plurality of such combined structures connected together along perforated lines and with pin hole strips along the marginal edges.

In another embodiment, the combined form and label construction which may be of continuous type or cut sheet type includes a label portion and a form portion which are not separated for use. In this embodiment, the label portion may be of rectangular shape having a plurality of glue strips on a back side to define a rectangular area or glue frame and a removable tear strip near one edge. The form portion may also be of rectangular shape and is sized to fold under the label portion to fit within the glue frame. The form portion also has a pair of parallel spaced-apart removable marginal strips which extend perpendicularly of the label portion. In addition, a backing sheet is removably secured over only the label portion while being permanently secured to the marginal strips of the form portion.

Still further, the form portion is provided with a series of holes along one edge for disposition over a glue strip on the label portion and a line of weakening adjacent the holes and parallel to the adjacent edge.

In use, after the form portion and label portion have been processed, for example through a laser printer, to receive information thereon, the backing sheet is removed. At this time, the two marginal strips of the form portion are also removed with the backing sheet thereby providing a reduced width form portion. The reduced form portion is then folded under the label portion fitting within the adhesive strips on the back side of the label.

The label is then affixed to a shipping container or carton via the adhesive strips. At this time, the holes near the one edge of the form expose corresponding areas of the adhesive on the back side of the label portion to the shipping carton so as to allow adherence of the label portion to the container.

Upon receipt, a recipient would gain access to the pocket defined, in part, by the label portion by removing the tear strip. The form portion can then be snapped out of or otherwise removed from the pocket. To this end, the line of weakening provided in the form portion adjacent to the strip containing the holes permits separation of a major portion of the form portion from the remainder of the form portion for pulling through the opening formed upon removal of the tear strip from the label portion.

This second embodiment may also be sized to be 8½"×11" or any other suitable size for a cut sheet or a continuous form. Further, the form portion may be secured to the label portion along a horizontally disposed fold line or about a vertically disposed fold line.

In still another embodiment, which is similar to the second embodiment, the form portion may be provided with two marginal strips which can be manually removed along suitable lines of weakening in the form portion. The remaining form portion may then be folded, if necessary, for example along a fold line. Next, a backing sheet which extends across the entire back side of the label portion is removed to expose the lines of glue on the label portion. The folded form is then folded over the back side of the label portion and the resultant folded construction is then applied to a shipping carton in a manner as the second embodiment described above. In this third embodiment, the form portion may be provided with a series of holes along one edge adjacent to the packing list portion so as to permit exposure of the adhesive on the back of the packing list to the shipping carton.

While the combined construction is described with respect to a form and label construction of rectangular shape, it is to be understood that the construction may be of other shapes and for other uses. In this respect, the construction may provide a message portion for receiving information and an interconnected label portion having a frame of glue on a back side for forming a pocket when applied to a container, such as a shipping container. As above, the label portion includes a tear strip which can be removed in order to expose the contents of the pocket, i.e. to permit removal of the message portion. In this case, the message portion may be similar to the form portion of the first embodiment wherein the message portion is separated from the label prior to insertion into the pocket or may be of a type which is folded under the label portion before the label portion is secured to a carton.

BRIEF DESCRIPTION OF THE DRAWINGS

These and other objects and advantages of the invention will become more apparent from the following detailed description taken in conjunction with the accompanying drawings wherein:

FIG. 1 illustrates a front view of a combined form and label construction in accordance with the invention;

FIG. 2 illustrates a back view of the combined form and label construction of FIG. 1;

FIG. 3 illustrates a label portion of the combined form and label construction secured to a container and in a position to receive the form portion in accordance with the invention;

FIG. 4 illustrates a view of a container of FIG. 3 during opening of the pocket formed by the label portion and the container;

FIG. 5 illustrates a cross-sectional view taken on line 5—5 of FIG. 4;

FIG. 6 illustrates a front view of a further modification of a combined form and label construction in accordance with the invention;

FIG. 7 illustrates a partial broken view of the backside of the construction of FIG. 6;

FIG. 8 illustrates the construction of FIGS. 6 and 7 during removal of the marginal strips from the packing slip portion;

FIG. 14 illustrates a front view of a third embodiment of a packing slip and label construction in accordance with the invention;

FIG. 15 illustrates a backside view of the construction of FIG. 14;

FIG. 16 illustrates a front view of the embodiment of FIG. 14 with the marginal strips removed from the packing slip portion;

FIG. 17 illustrates the construction of FIG. 16 in a folded over condition; and FIG. 18 illustrates the folded construction as applied to a container in cross-section.

DESCRIPTION OF THE PREFERRED EMBODIMENTS

Figure 9:
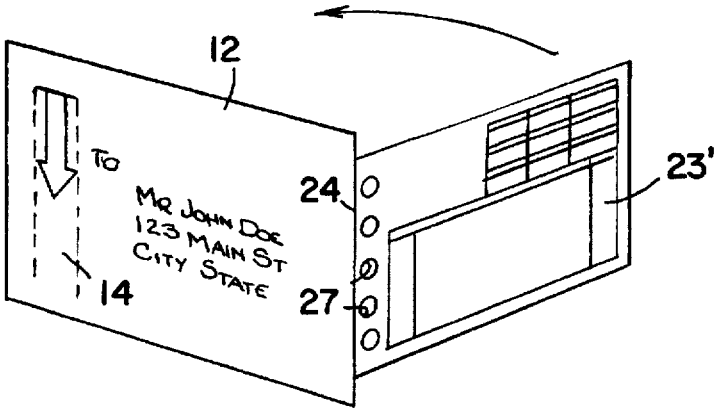
FIG. 9 illustrates a view similar to FIG. 8 with the marginal strips removed.

Referring to FIG. 1, the combined form and label construction 10 includes a form portion 11 of rectangular shape for receiving information thereon and a label portion 12 of rectangular shape which is removably connected to the form portion 11 along one edge of the form portion via a line of weakening 13 such as a perforation. The label portion 12 also has a removable tear strip 14 near one edge defined by a pair of perforations or other lines of weakening 15 as well as an aperture 16 or other suitable means for providing access to one end of the tear strip 14.

The front face of both the form portion 11 and the label portion 12 are provided with indicia or other information. For example, the front face of the label portion 12 is provided with an addressee block 17. A sender block (not shown) may also be provided where desired.

The indicia on the form portion 11 may be of any suitable type to indicate the type of goods which are to be shipped or any information regarding billing, invoicing or the like. For example, the form portion 11 may constitute a packing slip portion.

Referring to FIG. 2, the backside of the combined form and label construction 10 has a plurality of glue strips 18 on the label portion 12 to define a rectangular area or other suitable type glue frame. In addition, a backing strip 19 is disposed over a part of the backside of the label portion 12 along one edge and is releasably secured to the glue strip 18 adjacent and parallel to the tear strip 14. A backing sheet 20 is disposed over the remaining part of the backside of the label portion 12 and is releasably secured to the remainder of the glue strips 18.

Alternatively, the backing strip 19 may be disposed over the glue strip along the edge of the label portion 12 contiguous to the form portion 11 with the backing sheet 20 disposed over the remainder of the label portion 12.

As indicated in FIGS. 1 and 2, the form portion 11 is provided with a pair of intermediate fold lines 21 for folding of the form portion into a smaller size. Each fold line 21 extends perpendicularly relative to the label portion 12. Alternatively, the form portion 11 need have only one fold line at a mid-point for folding in half.

In this embodiment, the combined form and label construction 10 is one-piece formed as a cut sheet to constitute an 8½"×11" form. In such an embodiment, the entire construction 10 may be fed through a laser printer or other suitable printing means so that information can be imprinted on both the form portion 11 and the label portion 12 in the same printing operation. In this way, information regarding the addressee and the goods being shipped can be personalized. Of course, any other suitable dimensions can be used for the composite construction.

Referring to FIG. 3, the combined form and label construction 10 is usable with a shipping container 22 or any other suitable container. For example, assuming that goods are to be shipped in the container 22 to a particular addressee, and invoiced to the addressee the information regarding the goods is imprinted on the composite construction 10. Thereafter, the form portion 11 is separated from the label portion 12 along the line of weakening 13. The backing sheet 20 is then stripped, for example, manually, from the label portion 12 to expose the three lines of glue 18 to the right, as shown in FIG. 2. The label portion 12 is then affixed to the container 22 in a position as indicated in FIG. 3. At this time, the backing strip 19 remains in place so that the label portion 12 is not sealed at all four edges to the container 22. In this way, the label portion 12 forms a pocket with the container 22. The form portion 11 is then folded about the fold lines 21 into thirds and slipped into the pocket between the label portion 12 and the container 22. Alternatively, the form portion 11 may be folded in half or otherwise for sliding into the pocket formed by the label portion 12 and the container 22.

Thereafter, the backing strip 19 is removed, for example manually, so as to expose the remaining line of glue 18. The edge of the label portion 12 is then pressed against the container 22 so that the remaining glue strip 18 adheres to the container 22 thereby sealing the form portion 11 within the pocket.

As indicated in FIG. 5, the label portion 12 is secured to the container 22 in a manner so as to leave sufficient space therebetween for pocket to form in order to receive the folded over packing slip portion When the shipping carton 22 has been received by the indicated recipient, the tear strip 14 is stripped from the label portion 12 so as to expose the pocket as indicated in FIG. 4. The invoice 11 can then be removed through the opening formed by the removed tear strip 14 for reading by the recipient.

Referring to FIGS. 6 and 7, wherein like reference characters indicate like parts as above, the combined packing slip and label construction 10' may be of alternative construction and for example of a continuous form rather than a cut sheet. As indicated, the combined form and label construction 10' has a form portion 23 of rectangular shape for receiving information and a label portion 12 of rectangular shape which is connected to the form portion by a fold line 24. That is to say, in this embodiment, the form portion 23 is not removed from the label portion 12. Instead, the form portion 23 is sized to fold under the label portion 12.

As shown, the form portion 23 has a pair of parallel spaced apart marginal removable strips 25 extending perpendicularly of the label portion 12. As indicated, each marginal strip 25 is separated from the remainder of the form portion by a line of weakening such as a perforation 26. In addition, the packing slip portion 23 has a series of holes 27 along one edge and a line of weakening 28 adjacent the holes 27 and parallel to the fold line 24.

Referring to FIG. 7, the label portion 12 has a glue strip 18' along each edge to form a rectangular glue frame. The form portion 23 has a pair of glue strips 29, each of which is disposed along a marginal strip 25.

Figure 10:
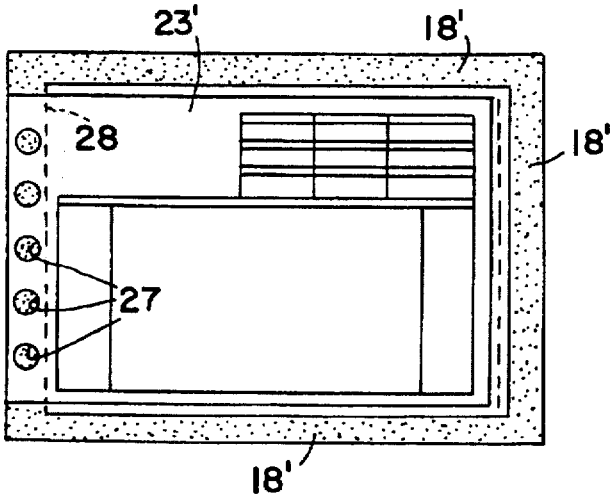
FIG. 10 illustrates a rear view of the label portion with the packing slip portion folded thereover.

As indicated in FIG. 7, a backing sheet 30 is disposed over the label portion 12 and the form portion 23. In this respect, the backing sheet 30 is releasably secured to the glue strips 18' on the label portion 12, for example, the sheet 30 may be provided with a silicone coating, pattern or strips to be able to release from the glue strips 18'. On the other hand, the sheet 30 has no silicone thereon over the form portion 23 so that the marginal strips 25 of the form portion 23 adhere to the backing sheet 30. Also, as indicated in FIG. 7, the form portion 23 has a row of holes 27 disposed for positioning over the adjacent glue strip 18' of the label portion 12 when the form portion 23 is folded over the label portion 12 as indicated in FIG. 10.

Figure 11:
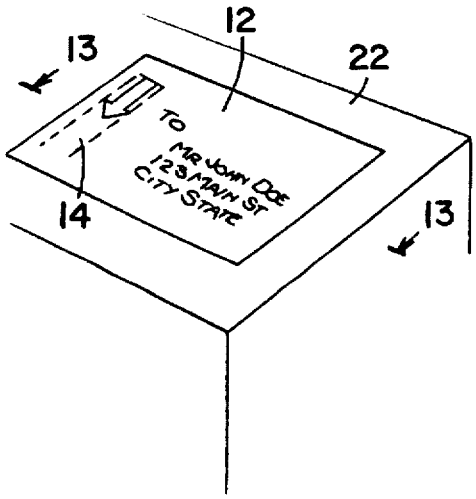
FIG. 11 illustrates the packing slip and label construction of FIG. 10 secured to a container.

In order to use the modified construction 10', the backing sheet 30 is manually removed from the backside of the construction 10' as indicated in FIG. 8. At this time, the marginal strips 25 separate from the remainder of the form portion 23 and peel off with the backing sheet 30. Next, the reduced size form portion 23' is folded over, for example in the 14 direction indicated in FIG. 9 so as to lie behind the face of the label portion 12. As indicated in FIG. 10, the form portion 23' fits within the glue frame formed by three of the lines of glue 18 while folding over the remaining glue line 18'. However, the holes 27 in the packing slip portion 23' expose this line of glue 18' as indicated in FIG. 10. The folded construction is then applied to a container 22 as indicated in FIG. 11. At this time, the three full lines of glue 18' and the line or series of exposed areas of glue along the remaining edge secure the label portion 12 along four sides to the container 22.

Figure 13:
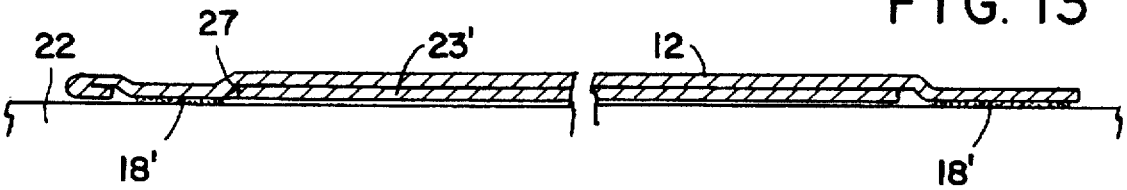
FIG. 13 illustrates a cross-sectional view taken on line 13—13 of FIG. 11.

As indicated in FIG. 13, the label portion 12 is secured to the container so as to form a pocket receiving the reduced form portion 23'.

Figure 12:
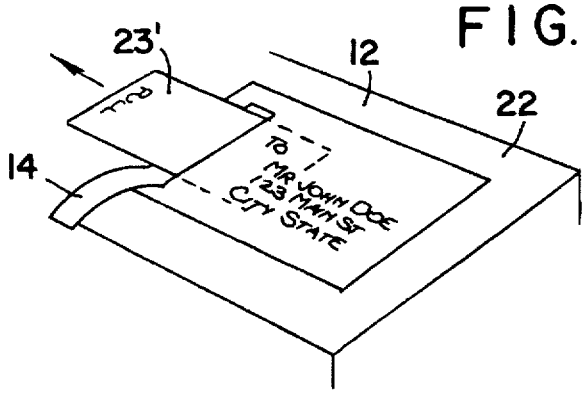
FIG. 12 illustrates an intermediate step in the opening of the pocket formed under the label secured to the container of FIG. 11.

Referring to FIG. 12, when the container 22 is received by a recipient, the tear strip 14 on the label portion 12 is removed in a manner as described above to gain access to the pocket defined by the label portion 12 and the container 22. At this time, the reduced form portion 23' is manually grasped at the exposed edge which may be provided with the designation "PULL". At this time, sufficient force is exerted on the form portion 23' so as to separate a major portion of the form portion 23' along the line of weakening 28.

Referring to FIGS. 14 and 15 wherein like reference characters indicate like parts as above, the combined form and label construction 10" may be formed in a different manner. As indicated, the construction 10" includes a label portion 12 having a tear strip 14 as above and a form portion 23 which is secured to the label portion 14 along a fold line 24. As above, the form portion 23 is provided with a pair of removable marginal strips 25 as well as a series of openings 27, for example of rectangular slot-like, oval or circular shape. In addition, a line of weakening 28 is provided parallel to the fold line 24 adjacent to the series of openings 27. As indicated in FIG. 15, the label portion 12 has a glue frame formed of four lines of adhesive 18' while the form portion 23 is void of glue lines.

A backing sheet 30 is also disposed over only the label portion 12. In this respect, the backing sheet 30 is releasably secured to the glue lines 18' on the label portion 12.

In use, the marginal strips 25 are manually removed (FIG. 16) and then the backing sheet 30 is removed from the label portion 12. Next, the reduced width form portion 23' is folded under the label portion 12 into a condition as indicated in FIG. 17. In this condition, the reduced form portion 23' is received within the glue frame defined by the three lines of glue 18' on the label portion 12. In addition, the remaining line of glue is exposed to the extent provided by the openings 27 of the reduced form portion 23'. The construction may then be applied to a carton as indicated in FIG. 18 so that the lines of glue 18' and the exposed segments of glue secure the label portion 12 to the carton 22.

One or more fold lines may be formed horizontally, as viewed, in the form portion 23 to facilitate folding and fitting within the glue frame on the label portion 12.

While the construction has been described with respect to a form and label construction, other modifications may also be made. In this respect, the label portion may be made of any suitable shape with a removable tear strip near one edge or side and a glue frame of any particular shape on the back side for adhesively securing the label portion to a container or other substrate. The form portion may be a message portion for receiving information while being sized to fit under the label portion and within the glue frame of the label portion. A backing strip would also be disposed over the back side of the label portion while being releasably secured to a part of the glue frame parallel and adjacent to the tear strip. Likewise, a backing sheet would be releasably secured to the remainder of the glue frame. In use, such a combined message and label construction would be used in the same way as the embodiment as described in FIGS. 1 to 5.

Thus, the shape of the combined construction is not limited to a rectangular shape.

The invention also provides a combined packing slip and label construction which can be made of any suitable size which can be processed through a laser printer or the like in order to impart information to the label portion and packing slip portion in the same operation.

The invention thus provides a combined packing slip and label construction which can be processed in a single operation prior to affixing to a shipping container or the like.

Further, the invention provides a combined packing slip and label construction which is of relatively inexpensively construction and which can be readily secured to a shipping container or the like in a simple secure manner.

What is claimed is:

1. A combined form and label construction comprising a form portion of rectangular shape for receiving information thereon;

a label portion of rectangular shape removably connected to said form portion along an edge of said form portion, said label portion having a removable tear strip near one edge thereof and a plurality of glue strips on a back side thereof to define a rectangular area;

a backing strip disposed over a part of said back side of said label portion and being releasably secured to one of said glue strips adjacent and parallel to one edge of said label portion; and a backing sheet disposed over a remaining part of said back side of said label portion and being releasably secured to the remainder of said glue strips thereon.

2. A construction as set forth in claim 1 wherein said label portion has a hole at one end of said tear strip to allow access to said end of said tear strip for removal of said tear strip from said label portion.

3. A construction as set forth in claim 1 wherein said form portion has at least one fold line for folding of said form portion on itself.

4. A construction as set forth in claim 1 wherein said form portion and said label portion constitute a one piece form and label construction.

5. A construction as set forth in claim 1 wherein said label portion has an addressee area thereon and an addressor area thereon.

6. A combined form and label construction for a shipping container comprising a label portion having a plurality of glue strips on a back side thereof for adhesively securing said label portion to a shipping container and for defining a pocket with the container, said label portion having a removable tear strip near one edge thereof to form an opening into said pocket upon removal of said tear strip;

a backing sheet disposed over said back side of said label portion and being releasably secured to some of said glue strips to allow affixing of said label portion to the shipping container upon removal of said backing sheet;

a form portion for receiving information thereon removably connected to said label portion along an edge of said form portion, said form portion being sized for fitting into said pocket; and a backing strip disposed over said back side of said label portion and being releasably secured to one of said glue strips adjacent one edge of said label portion to allow affixing of said label portion to the shipping container upon removal thereof to close said pocket after insertion of said form portion therein.

7. A construction as set forth in claim 6 wherein said glue strips define a rectangular area.

8. A construction as set forth in claim 7 wherein said label portion has a hole at one end of said tear strip to allow access to said end of said tear strip for removal of said tear strip from said label portion.

9. A combined packing slip and label construction comprising a label portion of rectangular shape having a plurality of glue strips on a back side thereof to define a rectangular glue frame and a removable tear strip near one edge thereof;

a form portion of rectangular shape connected to said label portion along an edge of said form portion and sized to fold under said label portion within said glue frame, said form portion having a pair of parallel spaced apart marginal removable strips extending perpendicularly of said label portion; and a backing sheet disposed over at least said label portion and being releasably secured to said glue strips on said label portion.

10. A construction as set forth in claim 9 wherein said form portion has a series of holes along one edge for disposition over a glue strip on said label portion.

11. A construction as set forth in claim 9 wherein each marginal strip of said form portion has glue thereon and said backing sheet is disposed over said form portion while being secured to said glue on said marginal strips to allow removal of said marginal strips from said form portion upon stripping of said backing sheet from said label portion and said form portion.

12. A combined form and label construction for a shipping container comprising a label portion having a plurality of glue strips defining a glue frame on a back side thereof for adhesively securing said label portion to a shipping container and for defining a pocket with the container, said label portion having a removable tear strip near one edge thereof to form an opening into said pocket upon removal of said tear strip;

a form portion for receiving information removably connected to said label portion along an edge of said form portion and being foldable under said label portion for disposition within said pocket; and a backing sheet disposed over at least said label portion and being releasably secured to said glue strips on said label portion to allow affixing of said label portion to the shipping container upon removal of said backing sheet.

13. A construction as set forth in claim 12 wherein said form portion has a pair of parallel spaced apart marginal removable strips extending perpendicularly of said label portion.

14. A construction as set forth in claim 13 wherein said backing sheet is disposed over said form portion and each marginal strip has glue thereon for releasably securing said form portion to said backing sheet.

15. A construction as set forth in claim 13 wherein said form portion has a series of holes along one edge for disposition over a glue strip on said label portion to allow securement of said label portion to the shipping container thereat.

16. A construction as set forth in claim 12 which further comprises a line of weakening in said form portion adjacent a side near said label portion to permit separation of a part of said form portion upon pulling of said part through an opening formed upon removal of said tear strip from said label portion.

17. A construction as set forth in claim 12 wherein said label portion has an addressee area thereon and an addressor area thereon.

18. A combined message and label construction comprising a label portion having a removable tear strip near one edge thereof and a glue frame on a back side thereof for adhesively securing said label portion to a container;

a message portion for receiving information thereon removably connected to said label portion along an edge of said message form portion, said message portion being sized to fit under said label portion and within said glue frame;

a backing strip disposed over said back side of said label portion and being releasably secured to a part of said glue frame, said backing strip being disposed parallel to one edge of said label portion; and a backing sheet disposed over said back side of said label portion and being releasably secured to the remainder of said glue frame thereon.

19. A construction as set forth in claim 18 wherein said label portion has a hole at one end of said tear strip to allow access to said end of said tear strip for removal of said tear strip from said label portion.

20. A construction as set forth in claim 18 wherein said message portion has at least one fold line for folding of said message portion.

21. A construction as set forth in claim 18 wherein said message portion and said label portion are each rectangular.

22. A construction as set forth in claim 18 wherein said message portion is foldable under said label portion and has a series of holes along one edge for disposition over a part of said glue frame on said label portion.

23. A construction as set forth in claim 22 wherein said message portion has a pair of removable marginal strips for reducing the size thereof prior to folding under said label portion.

24. A construction as set forth in claim 18 wherein said message portion has at least one removable marginal strip for reducing the size thereof prior to fitting under said label portion and within said glue frame.

25. In combination, a shipping container;

a label having a plurality of glue strips on a back side thereof securing said label directly to said container, said glue strips defining a glue frame to form a pocket with said container, said label having a removable tear strip near one edge thereof to form an opening into said pocket upon removal of said tear strip; and a form disposed in said pocket between said label and said container.

26. The combination as set forth in claim 25 wherein said form is folded under said label and is secured at one edge to said label, said form having a line of weakening adjacent said edge thereof to permit separation therealong.

* * * * *